US005225735A

United States Patent [19]

Tardy

[11] Patent Number: 5,225,735

[45] Date of Patent: Jul. 6, 1993

[54] ELECTRON TUBE WITH CYLINDRICAL HEXAGONAL GRID ALIGNED WITH RHOMBUS SHAPED CATHODE WIRES

[75] Inventor: Michel-Pierre Tardy, Thonon, France

[73] Assignee: Thomson Tubes Electroniques, Boulogne Billancourt, France

[21] Appl. No.: 692,721

[22] Filed: Apr. 29, 1991

[30] Foreign Application Priority Data

May 11, 1990 [FR] France ..... 90 05903

[51] Int. Cl.[5] ..... H01J 19/38

[52] U.S. Cl. ..... 313/350; 313/293; 313/348

[58] Field of Search ..... 313/293, 296, 297, 299, 313/348, 350

[56] References Cited

U.S. PATENT DOCUMENTS

| | | | |
|---|---|---|---|
| 3,573,535 | 4/1971 | Hughes | 313/348 |
| 3,852,663 | 12/1974 | Hunter | 313/348 |
| 4,230,968 | 10/1980 | Oguro | 313/348 |
| 4,254,357 | 3/1981 | Haas et al. | 313/348 |
| 4,546,286 | 10/1985 | Holenstein . | |
| 4,684,994 | 8/1987 | Urijssen et al. | 313/348 |
| 4,695,760 | 9/1987 | Anthony et al. | 313/348 |
| 4,728,852 | 3/1988 | Hoet | 313/348 |
| 4,739,213 | 4/1988 | Spitters et al. | 313/348 |
| 4,767,964 | 8/1988 | McGlothlan | 313/293 |

FOREIGN PATENT DOCUMENTS

| | | | |
|---|---|---|---|
| 868320 | 2/1953 | Fed. Rep. of Germany . | |
| 2276681 | 1/1976 | France . | |
| 2358011 | 2/1978 | France | 313/348 |
| 1003520 | 12/1961 | United Kingdom | 313/348 |

*Primary Examiner*—Donald J. Yusko
*Assistant Examiner*—J. E. Giust
*Attorney, Agent, or Firm*—Oblon, Spivak, McClelland, Maier & Neustadt

[57] ABSTRACT

An electron tube with concentric, cylindrical electrodes has at least one meshed type of grid, a mesh being defined by several rods in contact by their ends, each point of contact forming a node. In order to limit the grid current, the surface area of a node is reduced. Only three rods leave each node. The meshes are hexagonal.

7 Claims, 3 Drawing Sheets

ELECTRON TUBE WITH CYLINDRICAL HEXAGONAL GRID ALIGNED WITH RHOMBUS SHAPED CATHODE WIRES

BACKGROUND OF THE INVENTION

1. Field of the Invention

The present invention relates to tubes with concentric, cylindrical power electrodes. These tubes are, for example, triodes or tetrodes.

A triode tube comprises mainly a central cylindrical cathode emitting electrons when it reaches a sufficient temperature, with a control grid around the cathode and an anode surrounding the control grid. The electrons emitted by the cathode go through the grid and reach the cathode, if the potential of the grid and of the anode have appropriate values. Tetrodes have an additional grid, called a screen grid, inserted between the control grid and the anode.

2. Description of the Prior Art

The cathode is often made out of two sheets of emissive metal wires that are intersected to obtain a meshing. The assembly thus made has a cylindrical structure. Each end of the cylinder is fixed to a support. These cathodes are said to be caged.

The grids are also meshed. They may be made out of sheets of wires of a refractory material that are intersected to obtain a meshing. The wires are soldered to one another at each intersection. The assembly thus formed has a cylindrical shape, and its ends are connected to supports.

A second way of making a grid is to take a cylindrical sheet of refractory material and to pierce it with apertures that are regularly spaced out to obtain the meshing.

The material commonly used as a refractory material is pyrolitic graphite or molybdenum. Each mesh is defined by a succession of rods connected by their ends and the intersection between two rods is a node.

Because of this highly cut-out structure, the cathode and the grids are subject to vibrations that affect their mechanical stability. The distance between the cathode and the control grid is small. It is generally smaller than 1000 micrometers, and the vibrations that may occur cause appreciable variations in distance. These vibrations are detrimental to the efficient working of the tube. The same observations apply to the intergrid distances in the case of tetrodes or other multiple-grid tubes.

A measure of the importance of mechanical stability can be had if we add that the cathode may work at a high operating temperature (of the order of 1700° C.) and that it should also have high resistance to deformation. The grids will attain a lower temperature (of the order of 1200° C.) but should also stand up well to deformation.

Another condition that has to be integrated, in order to obtain efficient operation of the tube, is the tranparency of the grids. The rods and the nodes of the meshes form a barrier to the electrons coming from the cathode. The interception of a large number of electrons by a grid gives rise to a high grid current, especially in high-power tubes. This grid current prompts an additional heating of the grid and necessitates the use of a relatively powerful grid supply. The transparency of the grid depends on its geometry.

To make the grid, it is also necessary to take account of the distribution of the grid potential, between the rods. The potential must be distributed as regularly as possible. This is important for the control grid which is used to regulate the potential around the cathode. The latter condition also depends on the geometry of the grid.

An ideal grid, from the standpoint of potential and transparency, would have an infinity of very thin, vertical wires. The grid current would be very low, and the grid potential would be distributed very regularly around the cathode.

By contrast, this grid would have relatively poor mechanical resistance, especially if it were large sized.

This point has therefore led to the intersecting of the wires to increase the rigidity of the grid.

The grids that are frequently used have quadrilateral meshes, i.e. square, rectangular, rhombus-shaped or parallelogram-shaped meshes. Four rods leave one mesh node.

In high-power tubes, a grid of this type gets deformed, and it has been necessary to strengthen it by adding on rods: triangular meshes have been made. There are now six rods that leave each mesh node. The surface area of the nodes is greater, and so is the grid current.

The present invention seeks to overcome these drawbacks and proposes a gridded tube working with a lower grid current. To this end, it is sought to minimize the electron-interception surface area, in harming neither mechanical stability nor the distribution of the grid potential around the cathode.

SUMMARY OF THE INVENTION

The present invention relates to an electron tube with concentric, cylindrical electrodes, among them at least one central cathode and at least one meshed type of grid, a mesh being defined by several rods in contact by their ends, wherein the meshes have a hexagonal shape.

The meshes are preferably substantially identical. The hexagons are preferably substantially regular. When this grid surrounds a cathode with wires forming rhombuses, the intersection between two cathode wires is aligned with the central part of a grid mesh. Preferably, when a grid rod overlaps a cathode wire, the rod and the wire are perpendicular to minimize the overlapping surface area.

Preferably, the meshes are made out of a cylindrical sheet of refractory material pierced with hexagonal holes.

The material may be pyrolitic graphite or molybdenum.

BRIEF DESCRIPTION OF THE DRAWINGS

Other characteristics and advantages of the invention shall appear from the following description, illustrated by the appended figures, of which.

DETAILED DESCRIPTION OF THE INVENTION

Figure 1A:
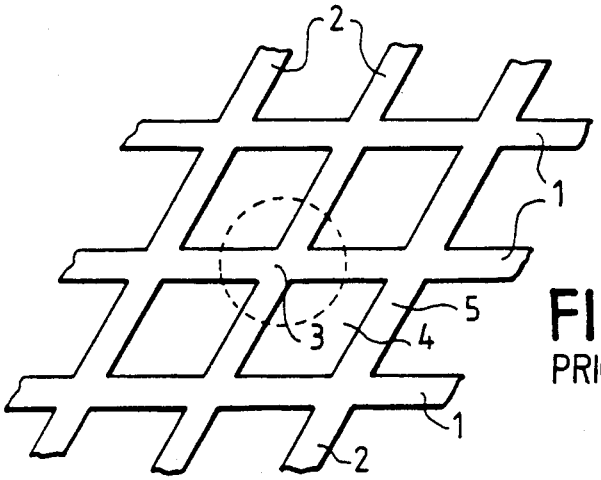
FIG.1a PRIOR ART
FIGS. 1*a* and 1*b* show a respectively rhombus-shaped and parallelogram-shaped meshing of a grid of an electron tube according to the prior art.
Figure 1B:
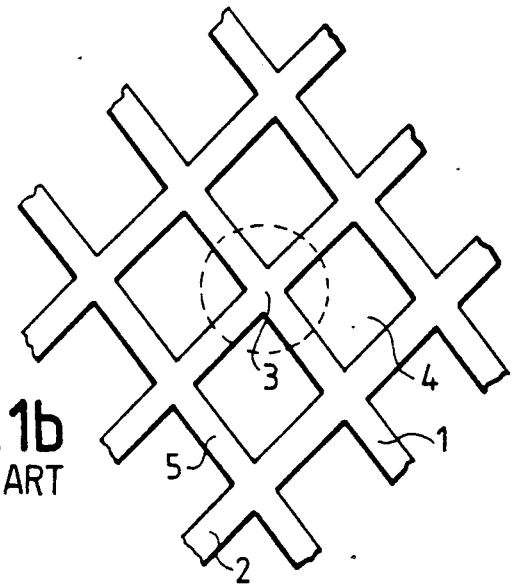
FIG.1b PRIOR ART

FIG. 1*a* shows a parallelogram-shaped meshing of an electron tube grid, of the triode type for example. FIG. 1*b*, for its part, shows a rhombus-shaped meshing.

Each of these meshings may be made out of two substantially parallel sheets of wires 1, 2 that are superimposed in being intersected. The wires 1 of one sheet are then soldered to the wires 2 of the other sheet, at all the points of intersection. Meshes 4, demarcated by portions of wires 1, 2 or rods 5, are obtained. Each intersection forms a node 3. Four rods 3 leave each node 3. A mesh 4 is constituted by four rods 5.

In FIG. 1*a*, a mesh 4 is parallelogram-shaped. It is constituted by four rods that are equal two by two.

In FIG. 1*b*, a mesh 4 is rhombus-shaped. It is constituted by four equal rods 5.

The wires 1, 2 used to make these grids are made of refractory metal, molybdenum for example.

A grid of this type can also be made out of a sheet of refractory material, graphite or molybdenum for example. The sheet is pierced with apertures by any known means, machining, sand-blasting or electro-erosion for example. The apertures are, preferably, regularly spaced out and have a shape appropriate to obtaining the meshing.

A grid of an electron tube, for example a triode, is cylindrical and it is mounted around a cathode that emits electrons. The electrons go through the grid when it is taken to a potential that is negative with respect to that of the cathode. The rods 5 and the nodes 3 form a screen against the electrons. Certain electrons are intercepted by the structure of the grid when it is taken to a potential that is positive with respect to that of the cathode. The intercepted electrons prompt the appearance of a grid current. A high grid current prompts an excessive increase in the temperature of the grid and calls for the use of a powerful grid supply.

In a average-power tube, it is possible to use a grid with a meshing as shown in FIGS. 1*a*, 1*b*. The grid current that is set up, because of the interception of electrons, is acceptable.

However, when a high-power tube is made, the grid has larger dimensions and is seen to lack rigidity.

Figure 2:
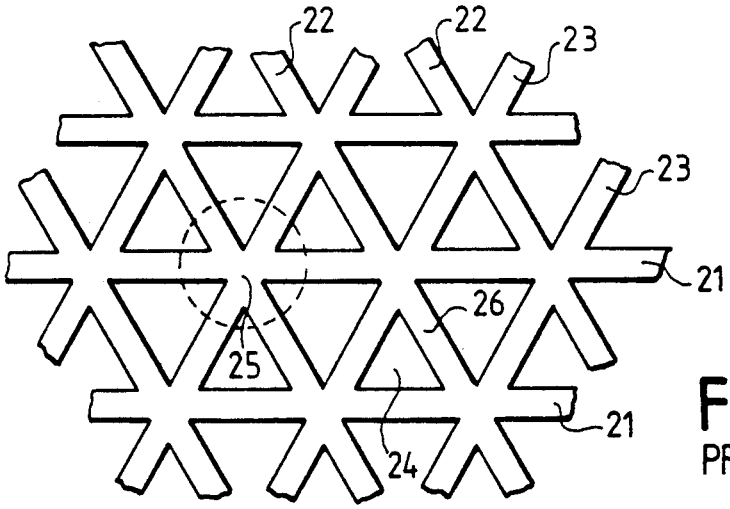
FIG.2 PRIOR ART
FIG. 2 shows a triangular meshing of a grid of an electron tube according to the prior art.

It had to be strengthened by being given a structure as shown in FIG. 2. A triangular meshing is made. As earlier, two sheets of intersected wires 22, 23 are made and a third sheet of wires 21, which are substantially horizontal, is added on at each intersection or node 25. Triangular meshes 24 are made. These meshes are defined by three portions of wires 21, 22, 23 or rods 26, the ends of which are in contact. Six rods 26 leave each node 26.

A meshing such as this gives a gain in mechanical stability and resistance to deformation. However, on the other hand, the grid current is also increased for the electron interception surface is increased, notably at the level of the nodes 25.

Figure 3:
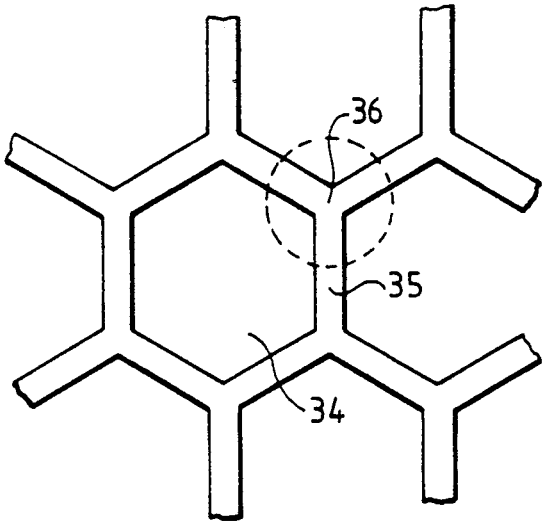
FIG. 3 shows a regular hexagonal meshing of a grid of an electron tube according to the invention.

FIG. 3 shows a regular hexagonal meshing of an electron tube grid according to the invention. This meshing has nodes 36. Only three rods 35 leave each node 36.

Each mesh 34 is now hexagonal: it is defined by six rods 35 connected by their ends.

The surface area of the nodes 36 is reduced as compared with the nodes of conventionally used types of meshing. The electrons intercepted by a grid of this type will be fewer in number and a power electron tube having a grid of this type will have a smaller grid current than the grid current of a tube of standard power.

The meshing shown in FIG. 3 is regular. Each mesh 34 is constituted by equal rods 35 and two successive rods 35 form an angle of 120°. The meshes are all substantially identical.

Figure 4:
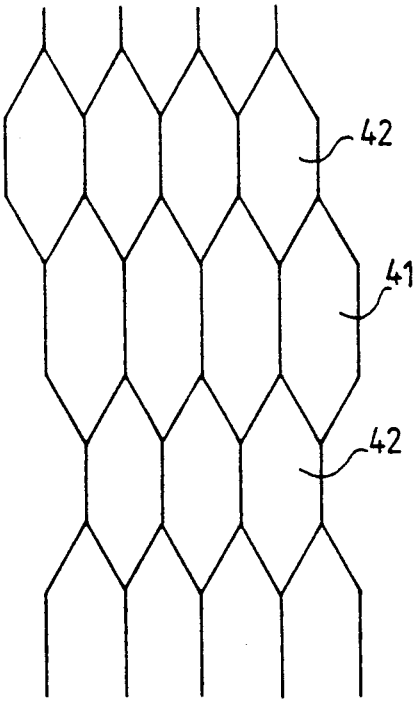
FIG. 4 shows an irregular hexagonal meshing of a grid of an electron tube according to the invention.

A case may be envisaged where the meshes are not all identical and where the hexagons are irregular. A meshing such as this is shown in FIG. 4. Figure shows large meshes 41 that are aligned with one another, and smaller meshes 42 that are also aligned with one another. Each mesh 41 or 42 is an irregular hexagon. The angles between two successive rods may be greater or smaller than 120°.

Figure 5:
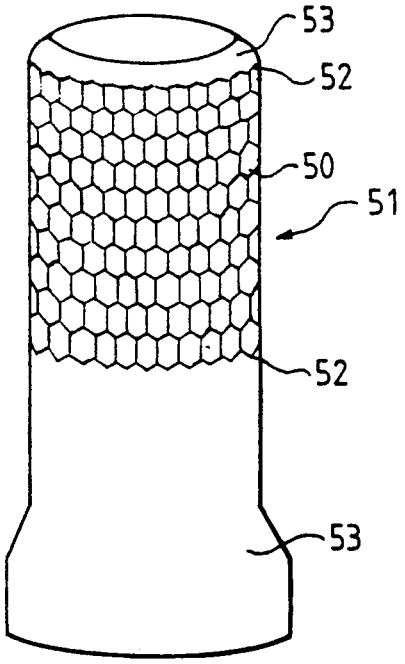
FIG. 5 shows an electron tube grid according to the invention.

FIG. 5 shows a view of a meshed grid of an electron tube according to the invention. The grid has regular hexagonal meshes 50. It has a beehive structure. It has a cylindrical meshed part 51. Each of the two ends 52 of the cylinder is now held on a support 53.

The hexagonal meshes shown in FIGS. 3, 4, 5 are all oriented in the same way. This is only an example: they may be oriented in any way. Notably, the meshes could have been rotated by 90°.

Preferably, the grid will be made out of a cylindrical sheet of refractory material, for example pyrolitic graphite or molybdenum. Holes are cut out in this sheet by any known means, for example machining, sand-blasting or electro-erosion. The holes are distributed regularly on the entire sheet. They are given the shape of hexagons. A hexagonal meshing is obtained. Each end of the cylinder is fixed to a support.

A grid such as this gives a gain in mechanical stability and in resistance to deformation as compared with grids with quadrilateral meshes.

The interception surface area has been reduced at the nodes if we compare it with that of grids with triangular meshes or quadrilateral meshes.

The regularity of the hexagons and their orientation should be chosen as a function of the mechanical and electrical parameters that the grid has to have.

The geometry of the rods, namely their length and their cross-section, as well as the angle of intersection between two rods, are chosen so as to provide transparency to electrons and control of the potential around the cathode, corresponding to the characteristics that the tube has to have.

For a given section of the rods and a given grid transparency, a regular hexagonal mesh permits smaller meshes than those commonly used. The result thereof is enhanced control of the potentials between the rods and near the cathode (if the grid is a control grid), an improvement in the cut-off voltage of the tube as well as improved distribution of the paths of the electrons.

For a given section of rods and a same control of the potentials between rods and near the cathode (if it is control grid), a regular hexagonal mesh permits larger meshes than those commonly used. The result thereof is greater transparency of the grid and a decrease in the grid current, notably during operation under high power.

Another advantage of the grids with regular hexagonal meshes appears when a caged cathode is used. The cathode and the grid can be aligned. In multiple-grid tubes, the cathode will be aligned with the control grid and also with the other grids.

Figure 6:
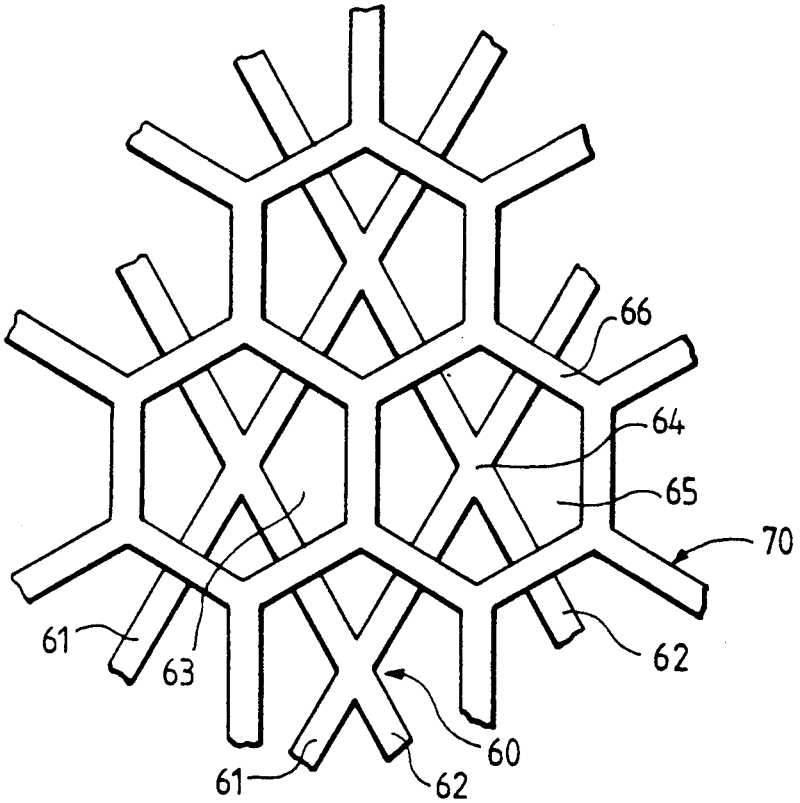
FIG. 6 shows the superimposition of a cathode meshing and a grid meshing of an electron tube according to the invention.

FIG. 6 shows a meshing 60 of a caged cathode covered with a meshing 70 of a control grid of an electron tube according to the invention. The cathode meshing 60 is constituted by two groups of wires 61, 62, where two wires of a same group are substantially parallel, the two groups being intersected. Rhombus-shaped meshes 63 are made.

The wires 61, 62 of the cathode emit electrons when they are heated. An intersection 64 between two wires 61, 62 has a substantial surface area that emits a high density of electrons.

The grid meshing 70 has hexagonal and regular meshes 65 formed by rods 66.

The position of the intersection 64 between two cathode wires 61, 62 can be contrived so that this intersection 64 is aligned with the central part of a grid mesh 65. This device increases the quantity of electrons passing through the grid.

In the case of multiple-grid tubes, all the grids will be aligned with one another and will be identical, so that the intersection 64 between two cathode wires 61, 62 will be positioned in the central part of all the grid meshes.

It may also be sought to minimize the surfaces of cathode wires 61, 62 covered by a grid rod 66. The position of the grid rods 66 covering a cathode wire 61, 62 can be contrived so that they are perpendicular to this cathode wire 61, 62. As compared with standard structures, for a same degree of control of the potentials between rods, and close to the cathode, the transparency of the grid is improved.

The invention is applicable as much to control grids as to other grids (screen grids, barrier grids etc.).

This type of hexagonal meshing is particularly suited to the tubes in which the inter-electrode distance is small for the meshing offers very high mechanical stability and excellent resistance to deformation.

The hexagonal meshing makes it possible to minimize the grid current and properly control the potential between the rods.

A grid with hexagonal meshes can advantageously be integrated into a tube with high gain and low driving power.

What is claimed is:

1. An electron tube comprising concentric, cylindrical electrodes wherein at least one of said electrodes is a central cathode with cathode wires intersected and shaped to form a plurality of rhombuses, wherein at least one of said electrodes is a hexagonal-shaped meshed grid with said meshed grid being defined by a plurality of rods in contact at their ends, and wherein an intersection between two of said cathode wires is aligned with a central part of a respective one of said meshes of said hexagonal-shaped meshed grid.

2. An electron tube according to claim 1, wherein the meshes are substantially identical.

3. An electron tube according to either of the claims 1 or 2, wherein the hexagons are substantially regular.

4. An electron tube according to claim 1 wherein, when a grid rod overlaps a cathode wire, the grid rod and the cathode wire are perpendicular to minimize the overlapping surface area.

5. An electron tube according to claim 1, wherein the meshes are formed by apertures drilled in a cylindrical sheet made of a refractory material.

6. An electron tube according to claim 5, wherein the material is pyrolitic graphite.

7. An electron tube according to claim 5, wherein the material is molybdenum.

* * * * *